United States Patent [19]

Orbach

[11] Patent Number: 4,611,769

[45] Date of Patent: Sep. 16, 1986

[54] SLITTING AND REWINDING MACHINE

[75] Inventor: Peter Orbach, Lindlar, Fed. Rep. of Germany

[73] Assignee: Firma Kampf GmbH & Co. Maschinenfabrik, Mühlen, Fed. Rep. of Germany

[21] Appl. No.: 735,167

[22] Filed: May 17, 1985

[30] Foreign Application Priority Data

May 19, 1984 [DE] Fed. Rep. of Germany ..... 3418741

[51] Int. Cl.[4] ..... B65H 19/20; B65H 47/02

[52] U.S. Cl. ..... 242/56.9; 242/56 A; 242/81

[58] Field of Search ..... 242/56.9, 56.4, 56 A, 242/56.2, 81, 80

[56] References Cited

U.S. PATENT DOCUMENTS

| | | | |
|---|---|---|---|
| 2,417,001 | 3/1947 | Leroy et al. . | |
| 2,840,320 | 6/1958 | Csutor . | |
| 3,220,662 | 11/1965 | Ahlman et al. . | |
| 3,424,398 | 1/1969 | Garnier | 242/81 |
| 3,733,035 | 5/1973 | Schott, Jr. | 242/56 A |
| 3,869,046 | 3/1975 | Gerhart | 242/81 X |
| 3,885,749 | 5/1975 | Skacel | 242/56 A |
| 4,208,019 | 6/1980 | Dusenbery | 242/56.9 X |
| 4,431,142 | 2/1984 | Kataoka . | |

FOREIGN PATENT DOCUMENTS

| | | |
|---|---|---|
| 2654707 | 8/1978 | Fed. Rep. of Germany . |
| 2847556 | 2/1980 | Fed. Rep. of Germany . |

*Primary Examiner*—Stuart S. Levy
*Assistant Examiner*—Thomas R. Hannon
*Attorney, Agent, or Firm*—Bacon & Thomas

[57] ABSTRACT

A slitting and rewinding machine for a web to be slit into a plurality of strips, comprising two turnstyles for the reception of a plurality of winding shafts, which receive winding cores, and comprising a loading carriage for the supply of empty winding cores and for the reception of finished rolls. The technical problem is such a structure of the slitting and rewinding machine that particularly in the case of winding shafts having a small diameter a quick and reliable performance of the loading operation and of the unloading operation is possible. Each winding shaft is received on one end in a drive frame. The other end of each winding shaft is beared rotatable in a support frame. The support frames can be moved on an axial guide. One sliding device for the support frame with the respective winding shaft is associated respectively with the unloading station and the loading station. A loading carriage comprises on the one side a roll case and on the other side a sleeve case for each turnstyle.

12 Claims, 5 Drawing Figures

SLITTING AND REWINDING MACHINE

BACKGROUND OF THE INVENTION

1. Field of the Invention

The invention relates to a slitting and rewinding machine for a web to be slit into a plurality of strips, comprising two turnstyles for the reception of a plurality of winding shafts, which can be brought, by turning of the specific turnstyle, one after the other, into different working stations, such as unloading station, loading station, at least one rewinding station, and which receive, in a clampable manner, winding cores, and further comprising a loading carriage for the supply of empty winding cores and for the reception of finished rolls.

2. Description of the Prior Art

A slitting and rewinding machine of the said type has been described in the DE-OS No. 28 47 556. Therein the winding shafts of each turnstyle are taper bore mounted, on one side, in a bearing plate. The loading carriage is movable in the axial direction of the winding shafts. In the unloading station the full rolls are drawn off, with corresponding movement of the loading carriage. Correspondingly in the loading station empty cores are pushed onto the specific winding shaft by axial movement of the loading carriage. Such an arrangement demands a minimum diameter of the winding cores so that same cannot bend or sag. In any case taper bore mounting is not possible in the case of winding cores having a diameter of less than 20 mm. In addition, the long travelling paths of the comparatively heavy loading carriage limit the reduction of the loading and unloading time. The unloading and loading must be carried out successively, due to the fact that for this in each case an opposite travelling motion of the loading carriage is necessary. The time of disuse of the device within the loading station and the unloading station, consequently, is comparatively long in the case of the prior art slitting and rewinding machine. Due to the fact that such slitting and rewinding machines are utilized for the formation of thin rolls, the time of disuse may exceed the effective winding time so that by the long time of disuse the output of the machine is reduced.

SUMMARY OF THE INVENTION

An object of the present invention is such a structure of a slitting and rewinding machine that particularly in the case of winding shafts having a small diameter a rapid and reliable performance of the loading operation and of the unloading operation is possible.

According to the invention this object is solved by the following features:

(a) each winding shaft within a turnstyle is supported on one end in a drive frame of the drive plate;

(b) the other end of each winding shaft is beared rotatable in a support frame of a bearing plate;

(c) the support frames are movable on an axial guide of a carrying tube;

(d) one sliding device for the support frame with the respective winding shaft is associated respectively with the unloading station and the loading station;

(e) a loading carriage comprises on the one side a roll case and on the other side a core case for each turnstyle and is movable, transversely to the axis of the turnstyle, to the loading station and the unloading station, respectively.

The invention differs, in such a non-obvious manner, from the prior art that the winding shafts are movable in the axial direction so that in the unloading station it is possible to pull the winding shafts out of the cores of the finished rolls. On the other hand, in the loading station in each case the winding shafts are pushed into the cores of a series of empty cores. This arrangement enables primarily a supporting of the winding shafts in one or more intermediate positions in order to avoid sagging of the winding shafts. Loading and unloading can be carried out simultaneously in that a winding shaft is pulled out in the unloading station and another winding shaft is pushed in within the loading station.

In order to reliably guide the winding shafts in the loading operation, it is provided that for the displacement of the support frames a number of guide rails, corresponding to the number of the working stations, is arranged on the carrying tube of the bearing plate of the specific turnstyle.

The reliable engaging of the support frames is guaranteed in that the sliding device comprises a driver, which is movable in parallel with the specific guide rail, and, in addition, a drive unit.

In order to avoid a bending of the winding shafts during the axial removal from the specific turnstyle, it is provided that the bearing plate for each winding shaft comprises two double cone rollers, arranged at right angles to one another, the axes of which are aligned perpendicular to the axis of the specific winding shaft, and which support the winding shaft during the displacement period. One roller each of these double cone rollers supports the specific winding shaft in the unloading station and the other one in the loading station.

For thin and/or long winding shafts it is provided that each turnstyle comprises one or more intermediate styles with slide bearings for the winding shafts. Thereby a sagging of the winding shafts is excluded. The intermediate styles with the slide bearings do not hinder the pulling out and pushing in of the winding shafts. The number of the intermediate styles is to be adapted to the axial length of the winding shafts and, thus, to the width of the machine. This intermediate supporting of the winding shafts is possible for winding shafts of any width, as far as technically feasible.

In order to secure cycle-correct movement of the intermediate styles with the rotation of the turnstyle, it is provided that the intermediate styles are arranged on a central shaft of the turnstyle.

In order to place the cores in the correct axial alignment on the specific winding shaft in the loading station, it is provided that the core case of the loading carriage comprises a longitudinal channel with peripheral grooves for the reception of the cores, and that the core case can be lowered.

In order to enable the roll case to take over the finished rolls from the winding shaft, it is provided that the roll case of the loading carriage comprises guide plates at the distance of the rolls as well as a liftable retaining bar. After the pulling out of the winding shaft the finished rolls will roll into the loading carriage and will be stopped on the retaining bar.

In the storing position a sorting of the empty cores is carried out in such a manner that in a storing position for the loading carriage, sorting rails, directed to the peripheral grooves of the core case, for the cores, with a liftable retaining bar, are provided.

In the storing position also an ordered guiding of the finished rolls is guaranteed in that in the storing position guide rail, directed to the guide plate of the roll case, for the rolls are provided. It is secured by this configuration that the finished rolls can be conveyed immediately into a subsequent packing machine.

A rapid movement of the loading carriage is guaranteed in that the loading carriage is movable in the axial direction of the turnstyle between the storing position and a waiting position on a guideway.

The directing to the unloading station and also to the loading station is reached in that the loading carriage is movable perpendicular to the said guideway and perpendicular to the axis of the winding shafts into the loading station and unloading station and is alignable with the roll cases and core cases in each case onto the winding shafts in the unloading station and loading station.

BRIEF DESCRIPTION OF THE DRAWINGS

One embodiment of the invention will be described in the following with reference to the accompanying drawings, wherein.

DESCRIPTION OF THE PREFERRED EMBODIMENT

Figure 1:
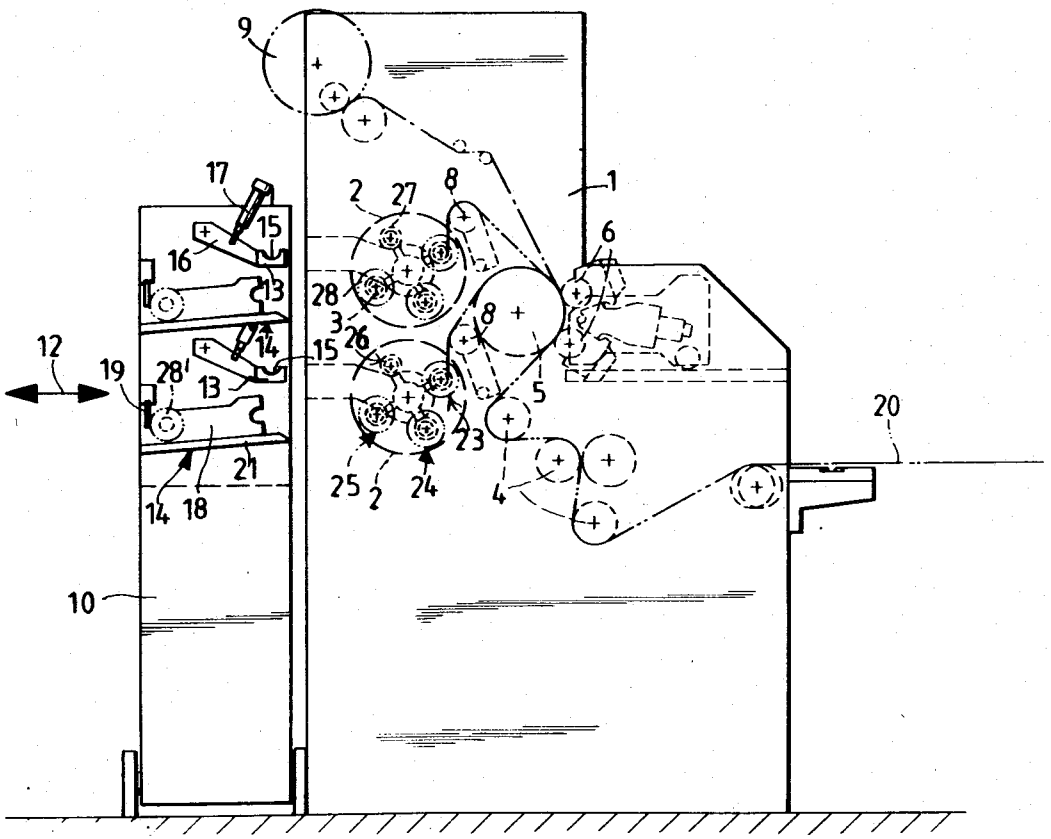
FIG. 1 shows a slitting and rewinding machine according to the invention as a schematical side view.

The slitting and rewinding machine is built up between two side shields 1, which are combined to a stable machine frame by crossbars, not shown. Within the side shields 1 normally one upon the other two turnstyles 2 are supported, which in this case are provided as quadruple styles and, thus, receive four winding shafts 3. Each turnstyle is rotatable so that the winding shafts 3 can be displaced into a rewinding station 23, a further rewinding station or waiting station 24, an unloading station 25 and into a loading station 26. The winding shafts 3 receive at distances, corresponding to the strip width, a plurality of cores 27, on which strips are wound into rolls 28. The cores 27 are frictionally clamped on the winding shafts; that is not described in detail. The structure of the turnstyle will be described in more detail in the following.

The slitting and rewinding machine comprises guide rollers 4 for a web 20, coming from a unwinding roll. The web 20 moves over a slitting roller 5, which is opposite to slitting blades 6, and is cut there into the specific narrow strips. The border strips are wound up in rolling-up units 9. The narrow strips possess a width of some millimeters up to 40 mm, or more. In each case strips are wound up in a length of 1000 mm, or even more, into a roll. It is e.g. adhesive tape, which is to be wound up into rolls for sale.

Each winding shaft 3 receives in the axial direction a plurality of cores 27, which are wound into finished rolls 28 in the rewinding station 23. Up to 50, or more, cores or rolls, respectively, may be arranged across the machine width. A loading carriage 10 is associated with the turnstyle 2, which carriage is movable on the one side between the waiting position 101, drawn in solid lines, and the storing position 102, drawn in dotted lines, in the direction of the double arrow 11 and on the other side is movable within the waiting position 101 in the direction of the double arrow 12 and is adjustable to the winding shafts in loading station 26 and unloading station 25. The loading carriage 10 comprises a loading case 13 for the empty cores, which are situated in peripheral grooves of a longitudinal channel 15. The loading case 13 is seated on guide levers 16, which are provided with a setting device 17 so that the loading case 13 can be lifted and lowered.

The loading carriage 10 comprises, in addition, unloading case 14 with a sloping bottom plate 21 and guide plates 18, arranged thereupon, the arrangement of which corresponds to the distance of the finished rolls 28. The rolls 28 consequently may run off between the guide plates 18 on the bottom plate 21. In addition, a retaining bar 19 is provided, which stops the rolls in the position 28'.

The structure of the turnstyle 1 will be described in detail in the following. Each turnstyle 2 comprises a drive plate 29, which is rotatably supported in one side shield 1, and a bearing plate 30 is supported in the opposite side shield 1. In the plates are in special bearings, not shown in detail, a central shaft 31 is supported, which is rotatable together with the drive plate 29 and the bearing plate 30. The drive plate 29 receives drive frames 32, into each of which a winding shaft 3 can be inserted. The drive frames 32 are coupled with a drive unit 33 so that by the drive unit 33 the specific winding shaft 3 may be driven. Each drive frame 32, thus, comprises a bearing and a driver for the reception and rotation of the winding shaft 3.

On the central shaft 31 an intermediate style 34 is seated, which carries slide bearings 35 for the specific winding shafts 3 so that the winding shafts 3 are supported in an intermediate position. This is primarily important for thin winding shafts, in order to avoid a bending thereof. One or more intermediate styles 34 may be provided. The number of said styles depends, on the one hand, upon the width of the machine and, on the other hand, upon the diameter of the winding shafts 3.

Figure 5:
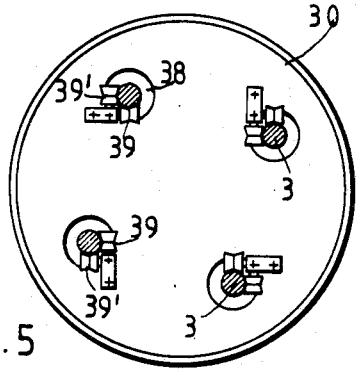
FIG. 5 shows a section along line V—V in FIG. 2.

The opposite bearing plate 30 carries, as an extension of the central shaft 31, a carrying tube 36 having, corresponding to the number of the winding shafts 3, a number of guide rails, not shown in detail. In these guide rails in each case support frames 37 are guided, in each of which a winding shaft 3 is rotatably supported. In addition, the bearing plate comprises passages 38 for the winding shafts. In the range of each passage 38 two double cone rollers 39 and 39', provided perpendicular to one another, are arranged in a manner as is evident from FIG. 5; one double cone roll 39 each supports the specific winding shaft 3 in the unloading position and the other double cone roller 39' supports the winding shaft 3 in the loading position; that will be explained in more detail later on. The total arrangement of the turnstyle, described up to now, with drive plate 29, bearing plate 30, carrying tube 36 and central shaft 31 is rotatable as a whole or in common so that the winding shafts 3 can be swiveled to the different working stations.

Figure 2:
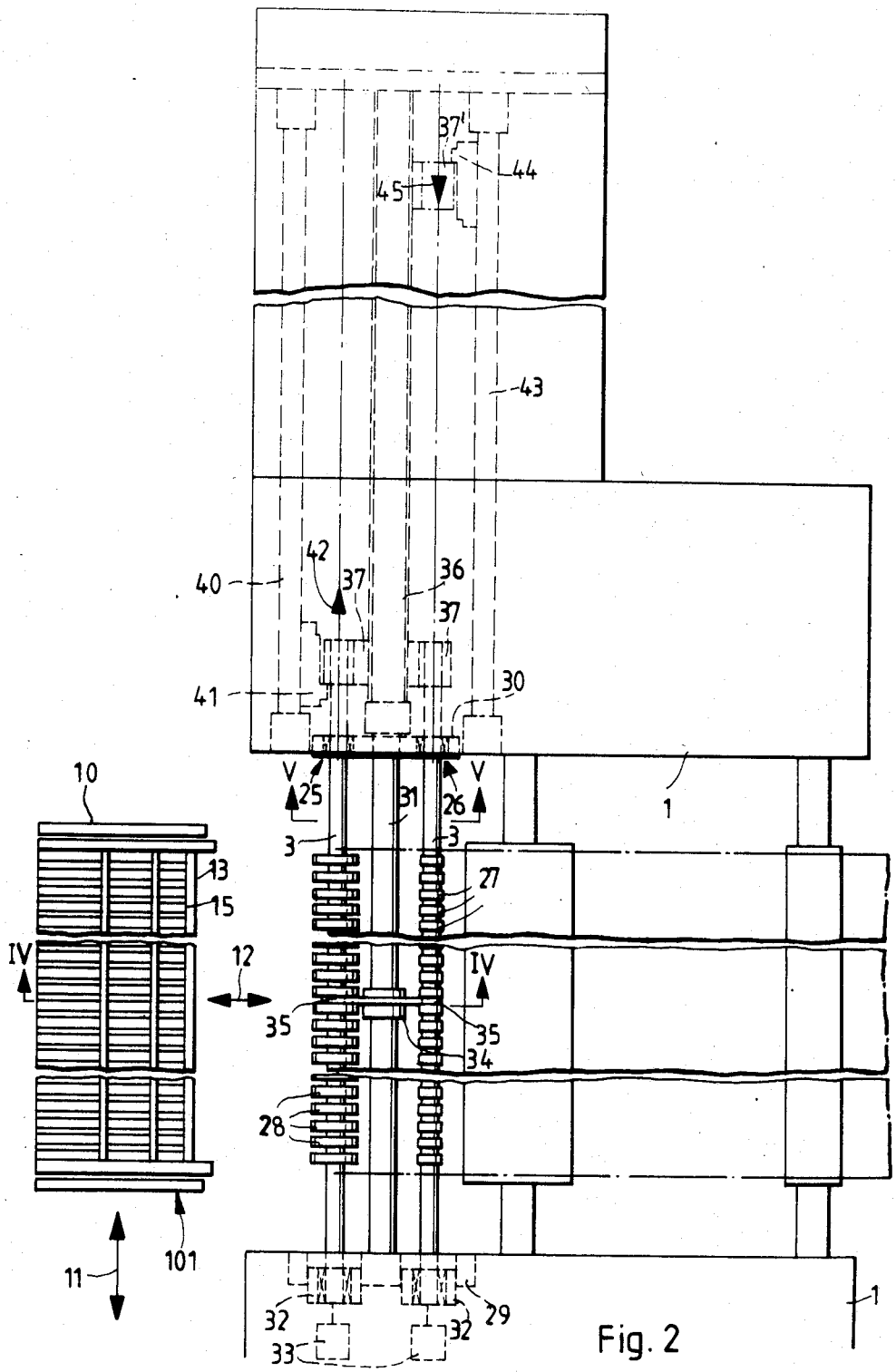
FIG. 2 is a top view of the slitting and rewinding part of the machine according to FIG. 1, FIG. 3 immediately adjacent to FIG. 2, shows the representation of the storing station for the loading carriage in a top view.

A sliding device 40 with a driver 41 is associated with the unloading station 25. The sliding device 40 may be a pressure cylinder, a chain drive, or another power-operated device. The sliding device 40 is arranged in parallel with the carrying tube 36 and enables, according to FIG. 2, an engagement of the specific support frame 37 in the unloading station 25. The sliding device 40 is movable in the direction of the arrow 42 and takes the support frame 37 with itself so that the support frame 37, together with the specific winding shaft 3, is pulled out of the working range of the machine. Accordingly in the loading station 26 a sliding device 43 with a driver 44 is arranged, which driver engages the support frame 37 in the position 37'. The driver 44 is drivable in the direction of the arrow 45 and pushes the specific support frame 37', together with the winding shaft 3, into the working range. The sliding devices 40 and 43 are held on the side shield or the machine frame and are not turnable with the turnstyle.

The loading carriage 10 is movable into the storing position 102, already mentioned. In the storing position 102 a core store device 47 with sorting rails 46 is provided. By means of a sorting device, not shown in detail, cores can be supplied in an ordered condition within the sorting rails 46. A retaining bar closes the sorting rails so that the sleeves are kept in the sorting rails. A roll store device 49 is provided opposite the sleeve store device 47. The roll store device 49 has guides 48, which correspond to the distance of the rolls and between which the rolls are received after the removal from the loading carriage.

The function of the rewinding machine will be described in the following on the basis of a complete working cycle of the turnstyles.

Figure 4:
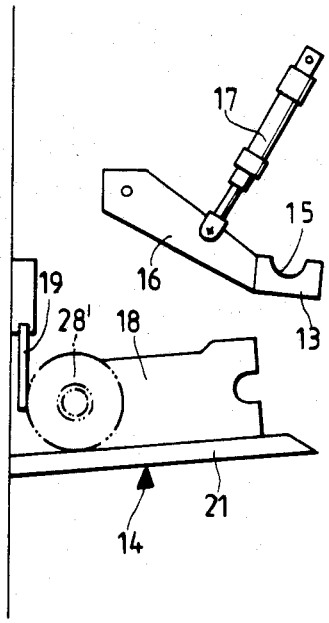
FIG. 4 shows a section along the line IV—IV in FIG. 2 with the loading carriage in solid lines in the waiting position and in dotted lines in the loading position, whilst
Figure 4:
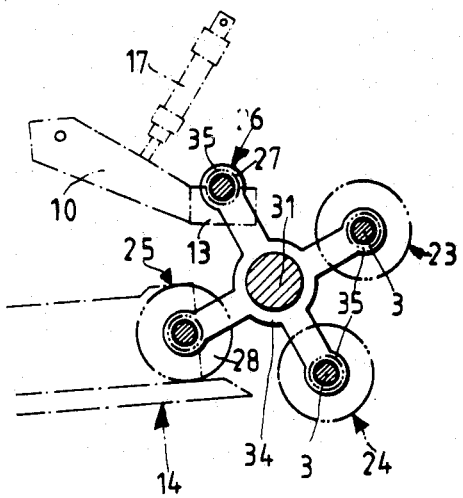

As soon as the rolls 28 are finished in the rewinding station 28, the turnstyle is swiveled by 90°. The web strips are chopped and are applied to empty cores 27 in the rewinding station 23. The rolls 28 are closed in the waiting station 24. These chopping operations are not described in detail, because they do not belong to the subject matter of the present invention. The rolls 28, previously positioned in the waiting station 24, reach the unloading station 25. The loading carriage 10 is in the waiting position 101 according to FIGS. 1 and 2. Now the loading carriage 10, according to the double arrow 12, is moved between the turnstyles, into the dot-dash position in FIG. 4 so that on the one side the guide plates 18 touch the winding shaft 3 between the rolls 28 and, on the other side, the loading case 13 is brought into the loading station 26.

Then the support frame 37 is engaged by the driver 41 and is pulled out in the unloading station 25 in the direction of the arrow 42 so that the rolls 28 are released and roll off between the guide plates 18. The rolls are stopped in the position 28' by the retaining bar 19. During the pulling out operation the winding shaft 3 runs over the double cone roller 39 and is supported thereon. During the preceding working cycle already one support frame 37 with a winding shaft had been pulled out in the unloading station. During the present working cycle this support frame is in the position 37' and is engaged by the driver 44 and is pushed into the loading station. The movement of the drivers 41 and 44 is effected substantially simultaneously. Thereby the winding shaft 3 enters the passages of the cores 27. The winding shaft 3 is guided, on the one side, by the double cone roller 39' and, on the other side, by the cores 28 themselves, which are supported in the loading case 13. The winding shaft 3 also extends through the slide bearing 35 and is finally received with its front end in the drive frame 32, in which a rotary-coupled reception is effected so that the winding shaft 3 can be taken along by the drive unit 33. In each case after completion of the sliding movement of the specific winding shafts the drivers 41 and 44 are moved back to their initial position. The support frame 37 in the unloading station remains with the winding shaft 3 in the pulled out condition so that, in the next swiveling, same may be swiveled or moved on a place for engagement by the driver 44.

Figure 3:
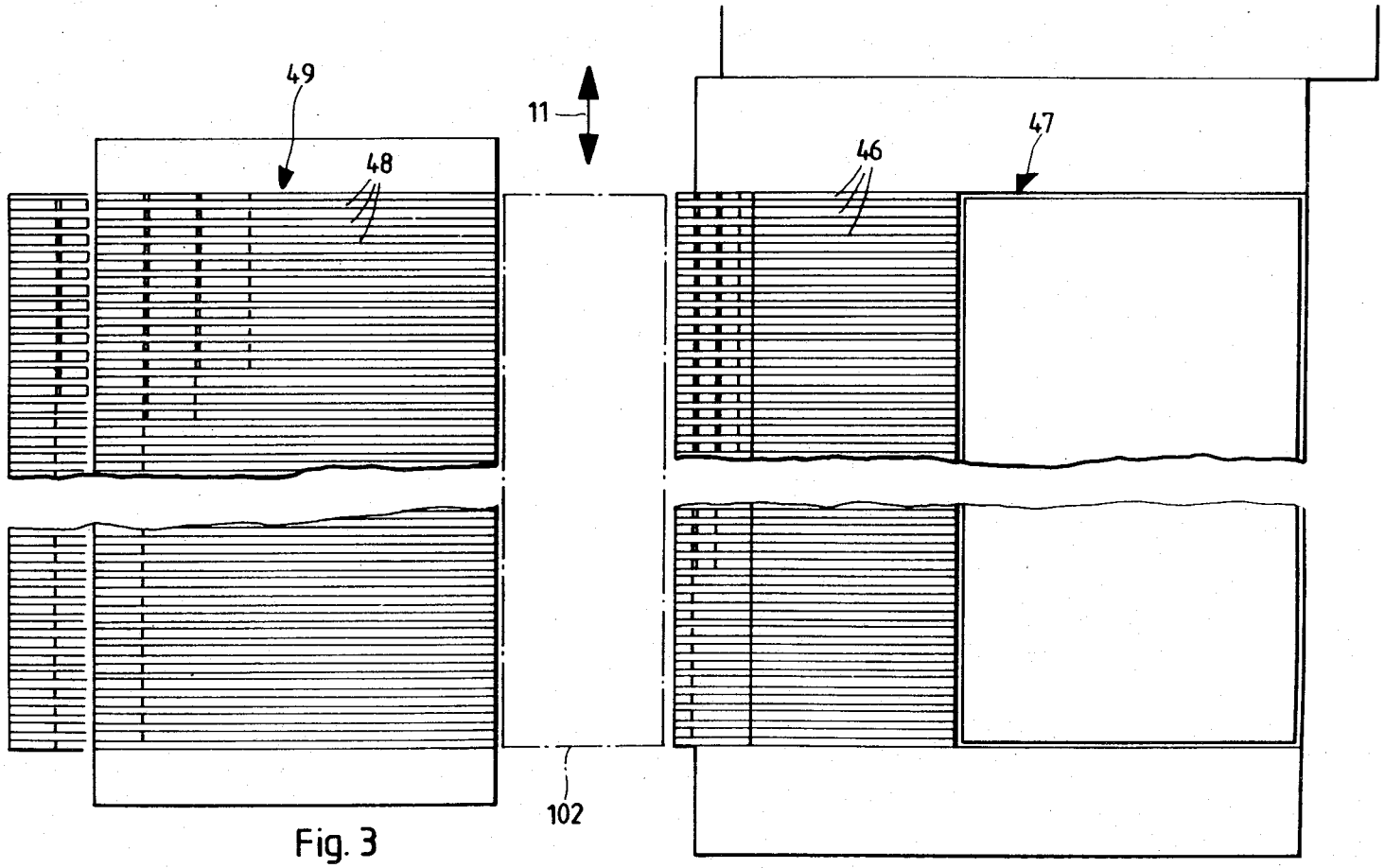

After completion of these displacement motions of the winding shafts 3 the loading case 13 is slightly swung off. Now the loading carriage 13 may be moved out of the turnstyles to the waiting position 101 according to FIGS. 1 and 2. Then the loading carriages is moved in the direction of the double arrow 11 into the storing position 102 according to FIG. 3. In the storing position 102, the core cases 13 are directed to the sorting rails 46 of the core store device 47 so that a series of cores 27 can be taken over into the core case. On the sorting rails 46, there are the corresponding retainers for the cores. The retaining bar 19 within the unloading case 14 is lifted. Now the finished rolls can roll off from the position 28' between the guides 48 of a roll store device 49. The rolls are stored in the roll store device 49. A packing machine is arranged immediately after the roll store device 49; however, that is not described herein.

We claim the following:

1. A slitting and rewinding machine for a web to be slit into a plurality of strips, comprising two turnstyles for the reception of a plurality of winding shafts, which can be brought, by turning of the specific turnstyle, one after the other, into different working stations, such as unloading station, loading station, at least one rewinding station, and which receive in a clampable manner, winding cores, and further comprising a loading carriage for the supply of empty winding cores and for the reception of the finished rolls, characterized by the following features:

(a) each winding shaft within a turnstyle is supported on one end in a drive frame of a drive plate;
(b) the other end of each winding shaft is beared rotatable in a support frame of a bearing plate;
(c) the support frames are movable on an axial guide of a carrying tube;
(d) one sliding device for the support frame with the respective winding shaft is associated respectively with the unloading station and the loading station;
(e) a loading carriage comprises on the one side a roll case and on the other side a core case for each turnstyle and is movable, transversely to the axis of the turnstyle, to the loading station and the unloading station, respectively.

2. A slitting and rewinding machine according to claim 1, characterized in that for the displacement of the support frames a number of guide rails, corresponding to the number of the working stations, is arranged on the carrying tube of the bearing plate of the specific turnstyle.

3. A slitting and rewinding machine according to claim 1, characterized in that the sliding device comprises a driver, which is movable in parallel with the specific guide rail, and, in addition, a drive unit.

4. A slitting and rewinding machine according to claim 1, characterized in that the bearing plate for each winding shaft comprises two double cone rollers, arranged at right angles to one another, the axes of which are aligned perpendicular to the axis of the specific winding shaft, and which support the winding shaft during the displacement period.

5. A slitting and rewinding machine according to claim 1, characterized in that each turnstyle comprises one or more intermediate styles with slide bearings for the winding shafts.

6. A slitting and rewinding machine according to claim 5, characterized in that the intermediate styles are arranged on a central shaft of the turnstyle.

7. A slitting and rewinding machine according to claim 1, characterized in that the roll case of the loading carriage comprises guide plates at the distance of the rolls as well as a liftable retaining bar.

8. A slitting and rewinding machine according to claim 1, characterized in that the core case of the loading carriage comprises a longitudinal channel with peripheral grooves for the reception of the cores, and that the core case can be lowered.

9. A slitting and rewinding machine according to claim 8, characterized in that in a storing position for the loading carriage, sorting rails, directed to the peripheral grooves of the core case, for the cores, with a liftable retaining bar, are provided.

10. A slitting and rewinding machine according to claim 8, characterized in that in the storing position guide rails, directed to the guide plate of the roll case, are arranged for the rolls.

11. A slitting and rewinding machine according to claim 8, characterized in that the loading carriage is movable in the axial direction of the turnstyles between the storing position and a waiting position on a guideway.

12. A slitting and rewinding machine according to claim 11, characterized in that the loading carriage is movable perpendicular to the said guideway and perpendicular to the axis of the winding shafts into the loading station and unloading station and is alignable with the roll cases and core cases in each case onto the winding shafts in the unloading station and loading station.

* * * * *